US008613693B2

(12) United States Patent
Mandel

(10) Patent No.: US 8,613,693 B2
(45) Date of Patent: Dec. 24, 2013

(54) HOLISTIC REPETITIVE EXERCISE AND EXERCISE BELT FOR OVERACTIVE BLADDER URINE NORMALIZATION

(76) Inventor: Justin Barry Mandel, Long Beach, NY (US)

( * ) Notice: Subject to any disclaimer, the term of this patent is extended or adjusted under 35 U.S.C. 154(b) by 289 days.

(21) Appl. No.: 13/065,443

(22) Filed: Mar. 22, 2011

(65) Prior Publication Data

US 2012/0245001 A1 Sep. 27, 2012

(51) Int. Cl.
*A63B 21/02* (2006.01)

(52) U.S. Cl.
USPC ..... 482/121; 482/124

(58) Field of Classification Search
USPC ..... 482/92, 121, 129, 130, 133, 909; 600/29–32, 37, 587, 593, 595; 128/885, 887, 898; 2/1, 69, 109, 300, 2/301, 311–313, 338, 219–221
See application file for complete search history.

(56) References Cited

U.S. PATENT DOCUMENTS

| | | | | |
|---|---|---|---|---|
| 1,966,175 | A | 7/1934 | Kappner | |
| 2,220,593 | A * | 11/1940 | Watson | 482/124 |
| 3,086,529 | A | 4/1963 | Munz et al. | |
| 3,278,185 | A * | 10/1966 | Bidopia et al. | 482/124 |
| 4,592,342 | A | 6/1986 | Salmasian | |
| 4,824,105 | A | 4/1989 | Goldenberg | |
| 4,846,157 | A | 7/1989 | Sears | |
| 5,528,775 | A | 6/1996 | Marenda | |
| 5,823,913 | A | 10/1998 | Aruin | |
| 5,843,008 | A | 12/1998 | Gerhard | |
| 6,475,124 | B1 | 11/2002 | Weiss | |
| 7,278,960 | B1 | 10/2007 | McGibbons | |
| 7,490,602 | B2 | 2/2009 | Sabri | |
| 7,648,441 | B2 * | 1/2010 | Silk | 482/1 |
| 7,704,121 | B2 | 4/2010 | Goodman | |
| 2006/0041200 | A1 * | 2/2006 | Dotter et al. | 600/502 |
| 2006/0293719 | A1 | 12/2006 | Naghavi | |
| 2007/0010380 | A1 | 1/2007 | Wilkinson | |
| 2008/0289623 | A1 | 11/2008 | Lee | |
| 2009/0112129 | A1 | 4/2009 | Lee | |
| 2010/0076358 | A1 | 3/2010 | Richardson | |

OTHER PUBLICATIONS www.peeless.com—last visited Jul. 24, 2013.*
www.endfrequenturination.com—last visited Jul. 24, 2013.*

* cited by examiner

*Primary Examiner* — Loan Thanh
*Assistant Examiner* — Rae Fischer
(74) *Attorney, Agent, or Firm* — Michael E. Zall

(57) ABSTRACT

An holistic exercise method for enhancing urine retention in a person having reduced urine retention and exercise belt therefore. The method includes:

a) providing an elastic resistance exercise belt of a size sufficient to encircle a users abdominopelvic region;
b) removably mounting the belt around the abdominopelvic region of the user;
c) expanding the abdominopelvic region outward as far as possible by the user against the resistive force of the belt; and then
d) pulling the abdominopelvic region back into the body as far as possible with the resistance belt elastically retained in a snug position against the exterior of the abdominopelvic region;
e) repeating a cycle comprising the expanding step c) and the pulling step d) for a sufficient number of cycles per day for a sufficient number of days to enhance the urine retention of the person.

5 Claims, 8 Drawing Sheets

HOLISTIC REPETITIVE EXERCISE AND EXERCISE BELT FOR OVERACTIVE BLADDER URINE NORMALIZATION

BACKGROUND OF THE INVENTION

1. Field of the Invention

This invention relates generally to the field of holistic exercise procedures for holistic treatment, and devices used in such exercises. More specifically, this invention relates to a repetitive exercise procedure that enhances urine retention by enabling the user's bladder to expand to its original size when the bladder space is invaded by the small and large intestine due, for example, to gas and intestinal spasms. This invention further relates an exercise belt that is used in such bladder expanding exercise.

2. Related Art

Applicant is aware of the following prior art relating to this invention, none of which teach or suggest the exercise method of this invention, the exercise belt used in such exercise method and the benefits derived therefrom and U.S. Pat. No. 1,966,175 to Kappner describes an abdominal truss used for supporting the abdomen and relieving hernia that includes integral hernia pads.

U.S. Pat. No. 3,086,529 to Munz et al. describes an elastic constriction band or ribbon of rubber having Velcro™ fasteners on the ends that is used on arms or legs for the purpose of controlling blood circulation.

U.S. Pat. No. 4,592,342 to Salmasian describes a belt which has a convex side which is pressed into the abdomen about "three fingers" over the navel displacing the abdomen inwardly from the front to suppress appetite.

U.S. Pat. No. 4,824,105 to Goldenberg describes the intermittent stretching and relaxing of abdominal muscles for massaging internal organs by applying adjustable intermittent pressure inwardly and upwardly through an inflatable bag on the abdomen and withdrawing air from the bag. The reference teaches that a benefit is to " . . . speed up the digestive process, promote elimination of waste, reduce excess abdominal fat, improve blood circulation and decongestion, and restore strength and elasticity to the muscles . . . "

U.S. Pat. No. 4,846,157 to Sears describes a motorized abdominal muscle training device, i.e., a band, for placement about the lower torso and a segment passing over the belly.

U.S. Pat. No. 5,528,775 to Marenda describes a women's garment that includes an elastic waistband for control of abdominal bloating, bulging, and rippling.

U.S. Pat. No. 5,823,913 to Aruin et al describes a belt that generates a signal to indicate the user to con tract the abdominal muscles. The patent describes the sequential relaxation and contraction of the abdominal muscles. It also describes increasing the abdominal volume by exercising the stomach muscles.

U.S. Pat. No. 5,843,008 to Gerhard describes a belt that includes a back portion and two wing portions that is worn by the patient for mitigating pain after surgery when the patient coughs.

U.S. Pat. No. 6,475,124 to Weiss describes a repetitive exercise for abdominal muscles by contracting the muscles against the suction produced by a vacuum.

U.S. Pat. No. 7,278,960 to McGibbons describes selected muscle tissue contacts against externally applied pressure and a strap used around the waist for the controlled development of abdominal muscles.

U.S. Pat. No. 7,490,602 to Sabri describes an external abdominal compression assembly having a balloon which is inflated prior to eating.

U.S. Pat. No. 7,704,121 to Goodman describes an elastically deformable maternity support belt.

US Published Application No. 2006/0293719 to Naghavi describes relieving " . . . a symptom of urinary hesitancy, shy bladder syndrome, DESD, urinary retention . . . " by modulation of the sympathetic-parasympathetic balance by the application of heat, carotid and/or ocular massage to a target muscle system.

US Published Application 2008/0289623 to Lee describes a therapeutic compression belt for alleviating menstrual cramps.

US Published Application 2007/0010380 to Wilkinson describes a garment that includes a tensioning abdominal band.

US Published Application 2009/0112129 to Lee describes an anti-pooling vest for inhibiting intradialytic hypotensive symptoms during hemodialysis treatment. The vest includes an inflatable bladder for applying compressive pressure on the internal organs.

US Published Application 2010/0076358 to Richardson describes an adjustable belt formed from "flexible but inextensible" material that indicates to the wearer that poor posture exists.

OBJECTS AND SUMMARY OF THE INVENTION

It is an object of this invention to provide an holistic repetitive urine retention exercise and a device to be used for such exercise.

More specifically, it is an object of this invention to provide a repetitive urine retention exercise and device therefore that expands the bladder to at least close to its original size when the bladder's space is invaded by the small intestine and/or large intestine due to gas and intestinal spasms.

It is yet another object of this invention to provide an holistic repetitive urine retention exercise and device therefore that prompts or assists the bladder to expand and return to its original size to thereby increase the bladder's urine capacity.

Another object of this invention is to provide a repetitive urine retention exercise and device therefore that reduces or eliminates frequent urination, nocturia, and/or reduces or eliminates the incidence of abdominal bloating.

Another object of this invention is to provide a repetitive urine retention exercise belt that is used in the exercise of this invention that is versatile and compact.

All of the foregoing objects and others are achieved by the holistic exercise method of this invention and belt for enhancing urine retention in a person having reduced urine retention. The method comprises the steps of:

a) providing an elastic resistance exercise belt of a size sufficient to encircle a users abdominopelvic region;

b) removably mounting the exercise belt around the abdominopelvic region of the user;

c) expanding the abdominopelvic region outward as far as possible by the user against the resistive force of the exercise belt; and then d) pulling the abdominopelvic region back into the body as far as possible with the resistance exercise belt elastically retained in a snug position against the exterior of the abdominopelvic region;

e) repeating a cycle comprising the expanding step c) and the pulling step d) for a sufficient number of cycles per day for a sufficient number of days to enhance the urine retention of the person.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

Figure 1:
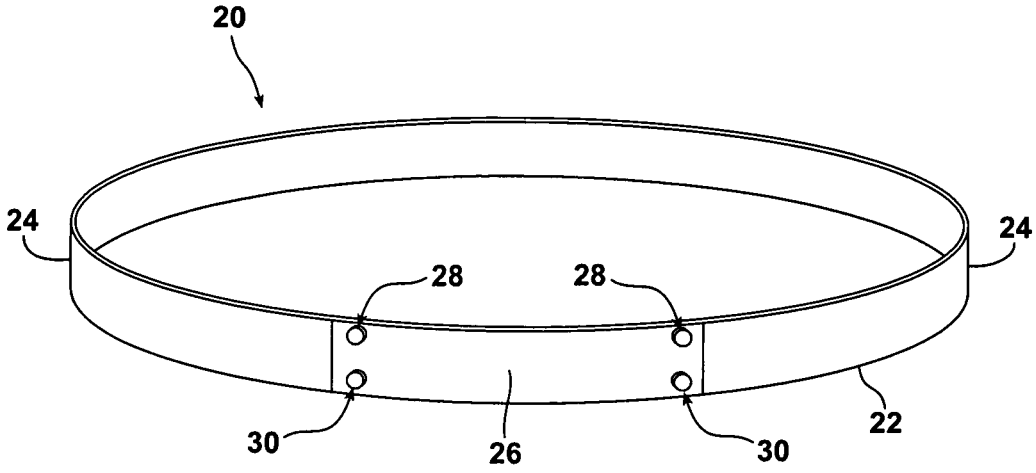
FIG. 1 is a perspective view of the exercise belt of this invention.
Figure 2:
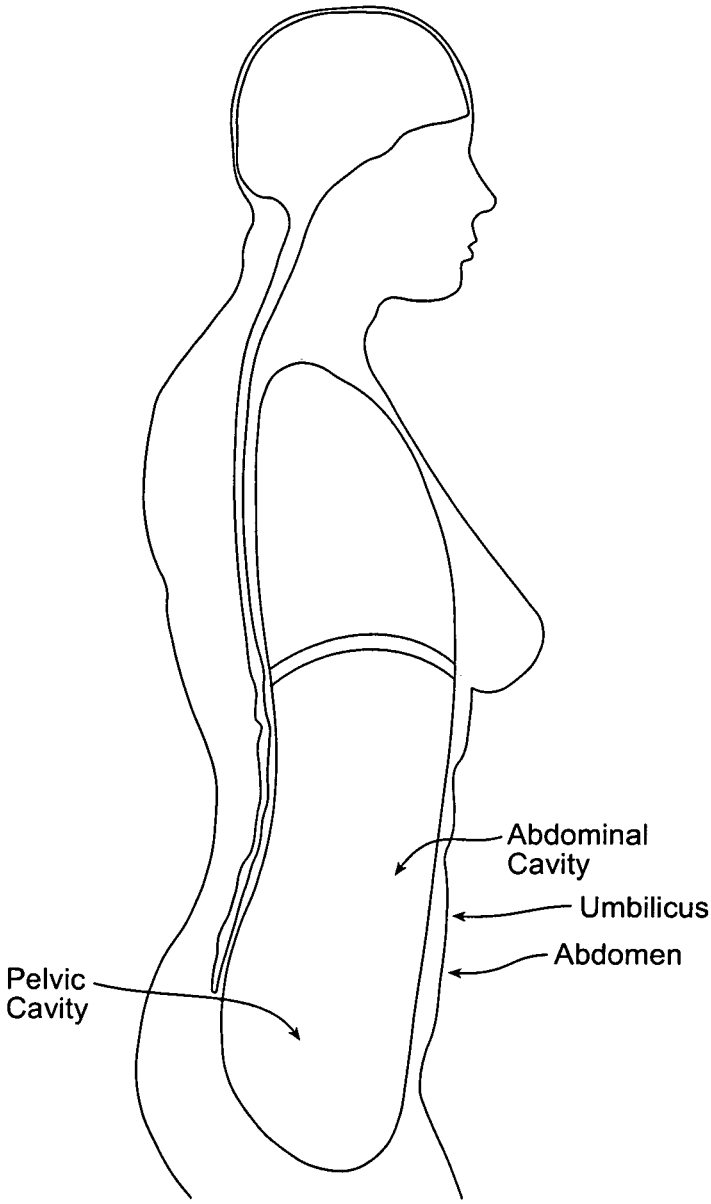
FIG. 2 is a schematic cross-sectional side view of the body of a person before the exercise belt is placed around the abdominopelvic region.
Figure 3:
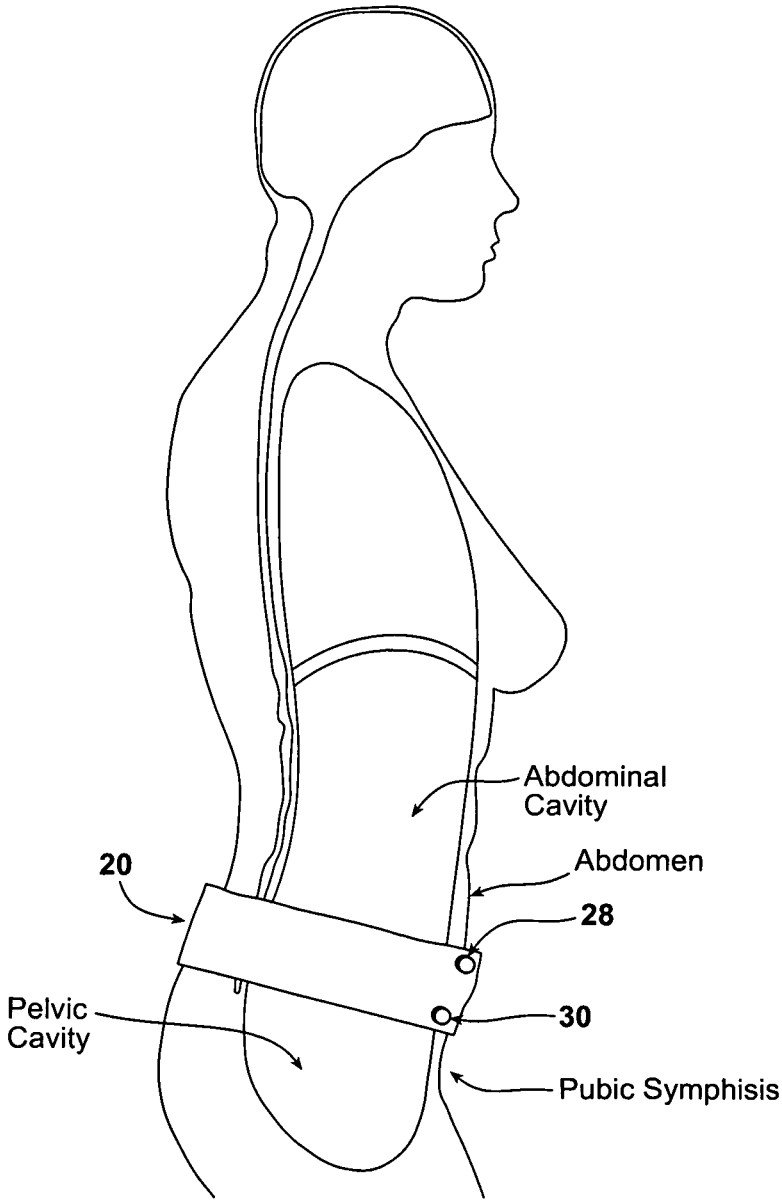
FIG. 3 is a schematic cross-sectional view of the body of a person with the exercise belt placed around the abdominopelvic region.
Figure 4:
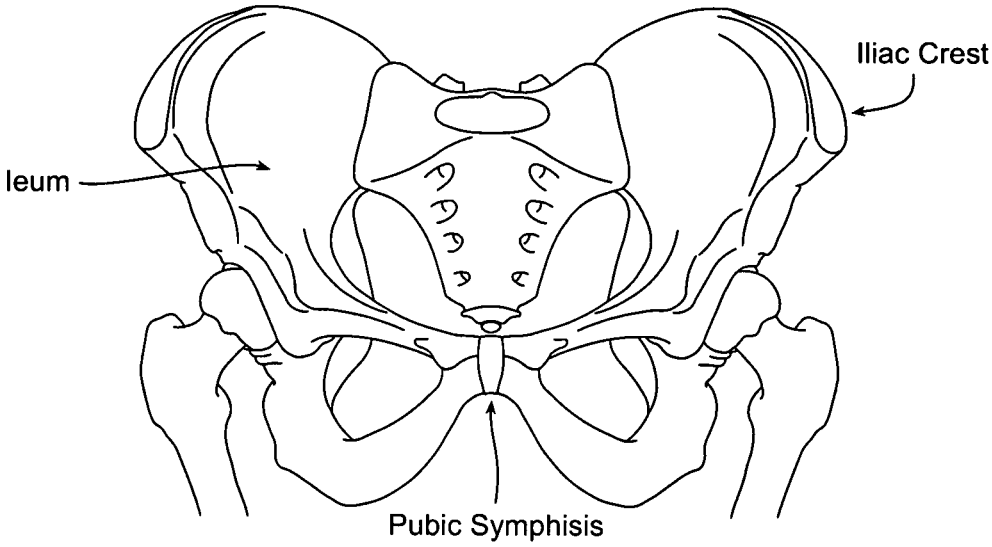
FIG. 4 is a front view of the skeletal structure of the hip area of a person.
Figure 5:
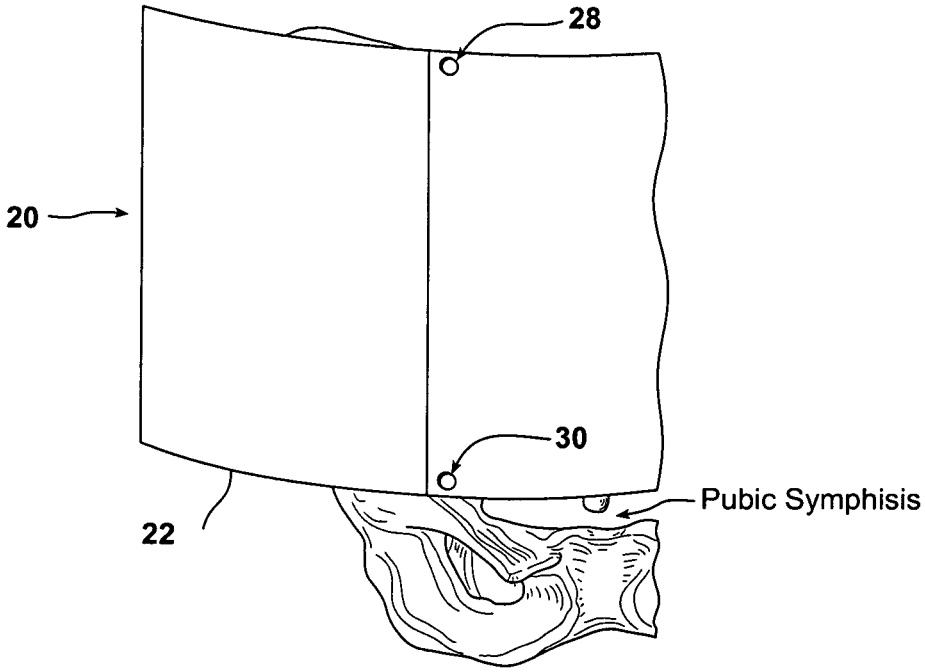
FIG. 5 is a front view of the skeletal structure of the hip area of a person showing the placement of the exercise belt thereon.
Figure 6:
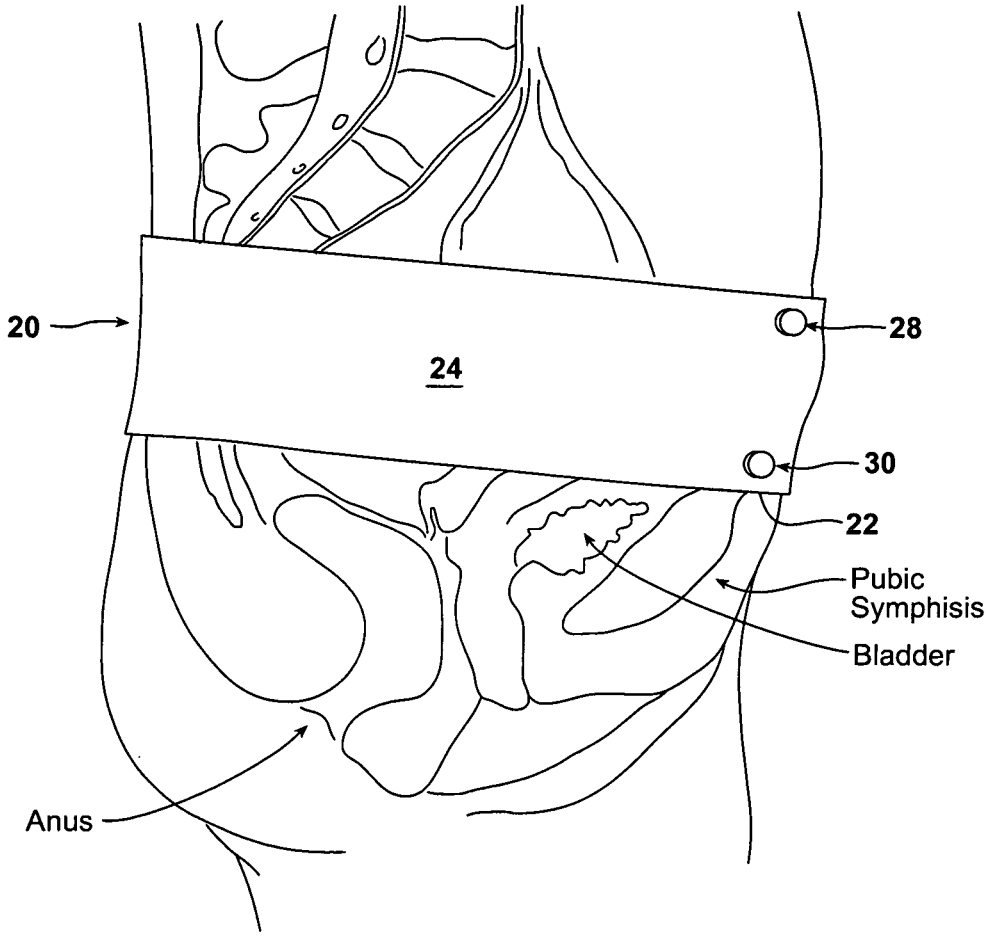
FIG. 6 is a side view of the exercise belt being worn by a person performing the repetitive urine retention exercise of this invention during the expansion step.
Figure 7:
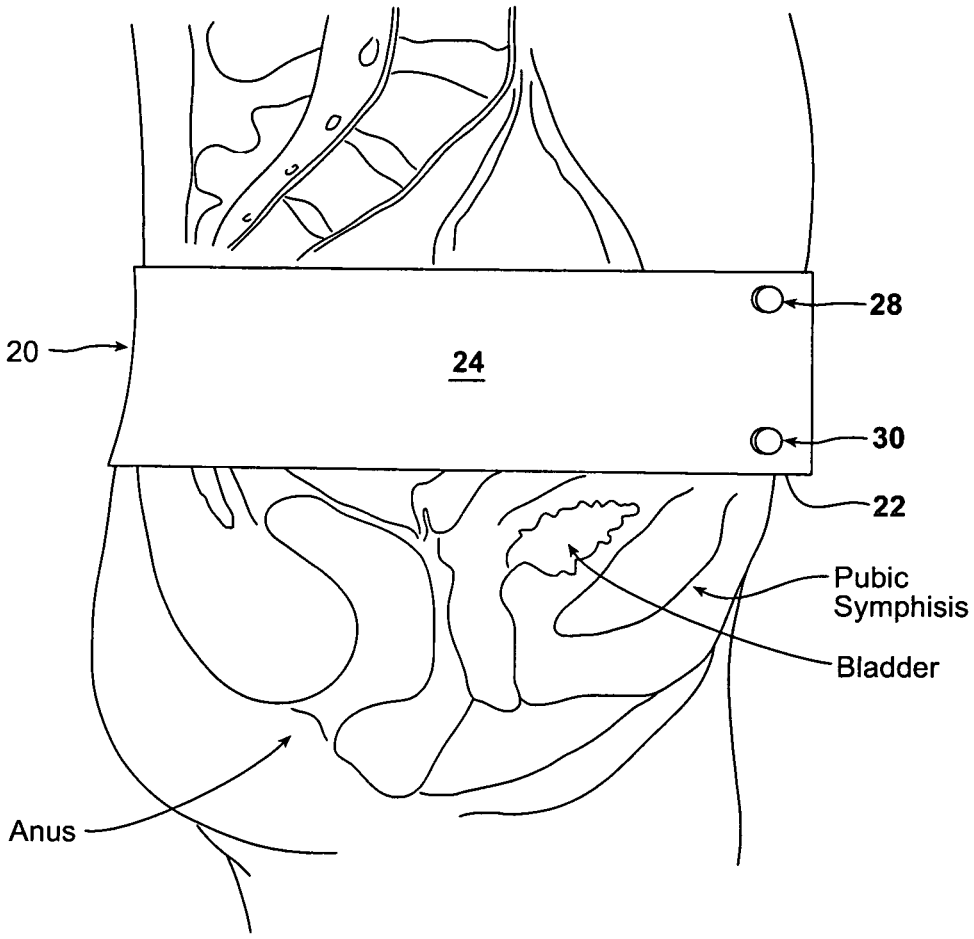
FIG. 7 is a side view of the exercise belt or resistance belt being worn by a person performing the repetitive urine retention exercise of this invention during the "pulling the abdominopelvic region back into the body as far as possible" step.

Throughout this application, reference is made to numerous anatomical organs in or locations on the body. Applicant has appropriately indicated these organs and relevant locations in FIGS. 2-7 and 11. If any relevant organs or locations referenced herein are omitted from the drawings or not referenced therein, one skilled in the art can readily determine their location and function relevant the invention described and claimed herein.

This invention is directed to an holistic exercise procedure and an exercise belt 20 used in such procedure. The exercise is primarily used for enhancing urine retention in a person (patient) that has reduced urine retention. Such reduced urine retention is evidenced by symptoms of frequent urination, nocturia, and perhaps abdominal bloating.

Broadly the method comprises the steps of:

a) providing an elastic resistance exercise belt 20 of a size sufficient to encircle a users abdominopelvic region;

b) removably mounting the exercise belt 20 around the abdominopelvic region of the user;

c) expanding the abdominopelvic region outward as far as possible by the user against the resistive force of the exercise belt 20; and then d) pulling the abdominopelvic region back into the body as far as possible with the resistance exercise belt 20 elastically retained in a snug position against the exterior of the abdominopelvic region;

e) repeating a cycle comprising the expanding step c) and the pulling step d) for a sufficient number of cycles per day for a sufficient number of days to enhance the urine retention of the person.

The resistance exercise belt 20 is made of a suitable elastomeric material which has inherent position memory, i.e., does not deform with repeated stretching and maintains its shape after such repeated stretching.

The repetitive exercise cycle of contraction and expansion of the abdominopelvic region creates additional space in the abdominopelvic cavity permitting the urinary bladder to fill up. This exercise is particularly useful for those people who suffer from overactive bladder (OAB) and frequent urination.

This bladder expansion exercise when done with the resistance exercise belt 20 allows the urinary bladder to expand and fill up with more urine by simultaneously moving gas out the large and small intestines and removing stiffness and spasms from both intestines, which can encroach upon and impact the space where the urinary bladder exists due to the turgor/turgid effect.

Generally, the turgor/turgid effect is the ability of an organ to occupy a maximal space within a given cavity, due to its elasticity and vascular pressure. When gas remains in the intestines and does not escape via the mouth or anus, i.e., either end of the gastrointestinal system, it remains stagnant inside the abdominopelvic and/or pelvic cavity(s). As the gas expands inside these cavities, the wall of the small and/or large intestine move into space occupied by the urinary bladder, effectively reducing the volume to which it can naturally expand. Due to this now limited capacity to hold a normal volume of urine, frequent urination and urinary incontinence now ensues. As a result of the use of the exercise method of this invention, the bladder is permitted to expand into the pelvic cavity and the urinary bladder can once again completely fill up.

Spasmodic and or stiff intestines can also cause the turgor effect to cause an over active bladder (OAB) and frequent urination. Inflexible intestinal walls and spasmodic and stiff intestines do not permit the bladder to expand into its own space.

Generally, the exercise routine or cycle consists of first mounting or wrapping the resistance exercise belt 20 around the exterior of the abdominopelvic region of the person. After the exercise belt 20 is in position the person pushes out against the exercise belt 20, without breathing. Preferably the pushing should expand the abdominopelvic region to about 95% of its capability or capacity. Subsequently, the abdominopelvic region is pulled in as far as possible, without breathing. This is one "cycle." This cycle is then repeated numerous times.

More specifically, for the user to obtain optimum results from the exercise of this invention, i.e., enhanced urine retention, the recommended number of cycles must be completed. In order to obtain the desired results, the user should complete in one exercise period at least about 50 complete cycles (which can be performed in about 50 seconds or more) up to about 750 cycles (which can be performed in about 5½ minutes or more) per day.

The number of cycles is dictated partially by the state of the patients abdominopelvic and pelvic cavity as evaluated by a physical examination. The more serious the findings, the more likely the patent (user) will need to complete a higher number of cycles.

After the user has completed all the required cycles for any particular day they may remove the exercise belt 20 and store it for use the next day.

For the user to receive the desired results from the exercise the appropriate number of cycles must be completed on a daily basis. The user should start with 50 complete cycles per day and slowly work up to as many as 750 cycles per day.

When a user first starts the exercise regimen, most will only be able to perform a maximum of about 50 cycles per day for the first week. If they can do more then the required 50 cycles they should strive to do so. Some users for the first few days may only be able to do 20 to 25 complete cycles. If this is the case, they should be encouraged to increase that number to at least about 50 repetitions per day as soon as they are able to do so.

For the user to maintain the enhanced urine retention from the exercise of this invention, the user should complete a minimum of 50 to 100 complete cycles per day. After obtaining enhanced urine retention (and the exercise routine is discontinued) and the overactive bladder symptoms reappear, the exercise regimen should be restarted to reduce or eliminate the symptoms.

It is possible for the user of the exercise of this invention to experience transitory stabbing like pain in the abdominal and pelvic regions after approximately 21 days of exercising using this routine. If the user experiences such transitory pain they should avoid performing the exercise for a day or two and then continue the regimen. Such pain is usually a signal that there is stiffness and gas accumulation in the intestines. If the user experiences such pain after achieving positive results, i.e., enhanced urine retention, and the pain subsides, they should be strongly encouraged to continue the regimen.

The resistance exercise belt 20, used herein may be of various shapes, styles, and sizes and may be unitary exercise belt or exercise belt requiring attachment of the ends to encircle the person.

A preferred exercise belt and its positioning on the body while being used in the exercise of this invention is depicted in FIGS. 1, 3, 5-10.

The preferred location of the belt 20 on the body while performing the exercises of this invention, hereinafter referred to as the strategic locus, is important in order to achieve the optimum benefits from the exercise. Even though the exercise of this invention specifically targets the organs immediately surrounding the urinary bladder, the exercise is primarily directed at the urinary bladder within the pelvic cavity. Thus positioning of the exercise belt 20 on the person practicing the exercise is important.

Figure 11:
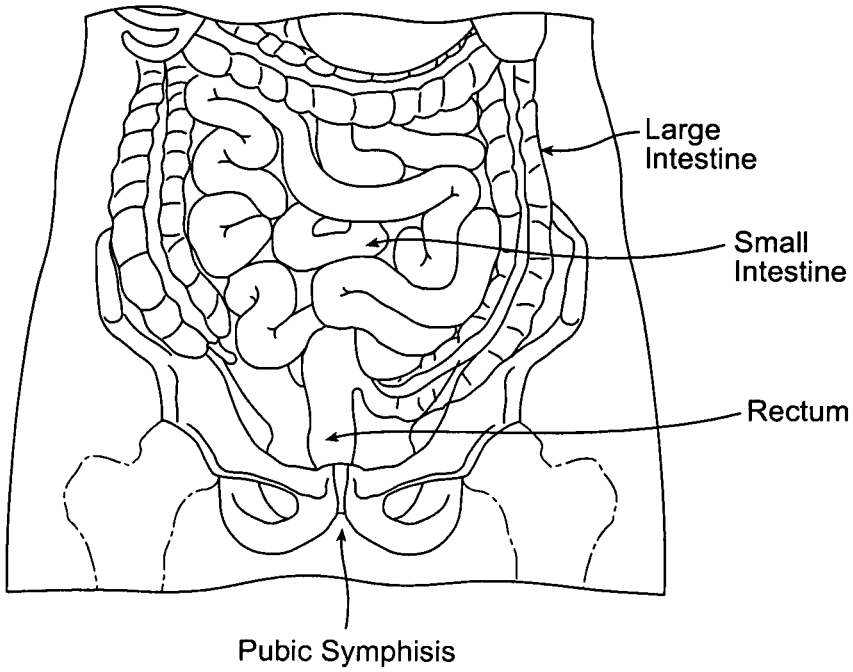
FIG. 11 is an anatomical chart of the gastrointestinal area indicating the anatomy therein.

Referring to FIGS. 3-7, and additionally FIG. 11, the strategic location of the exercise belt 20 is optimally when the bottom edge 22 of the exercise belt 20 is physically placed close to and just superior to the Pubic Symphysis. The Pubic Symphysis is located immediately anterior to the urinary bladder which resides inside the pelvic cavity. This location provides for maximum effectiveness and is the preferred placement for the exercise belt 20. Due to the fact that the exercise belt 20 is sitting relatively low on the abdominopelvic cavity, the sides 24 of the exercise belt will simultaneously be positioned over the iliac crest of the ileum or on top of what people commonly refer to as the "hip bones", e.g., see FIG. 3. Since the exercise and exercise belt 20 used therewith targets what is happening primarily inside the pelvic cavity, if the exercise belt 20 is placed higher on the body and is centered nearer or closer to the umbilicus, the effectiveness of the exercise will decrease and the user will not receive the optimum benefits.

The use of the exercise belt 20 at the strategic locus, particularly the preferred exercise belt of this invention, provides the user with multiple benefits. These benefits include physical benefits, psychological benefits, as well as mind-body coordination benefits.

The preferred exercise belt 20 of this invention is shown in FIG. 1 and also FIGS. 3, 5-10. The exercise belt 20 comprises an elastic material 26 in the front portion of the belt 20. The elastic material 26 has a low hysteresis, i.e., the continued "working" or expansion and contraction of the exercise belt 20 does not cause a significant permanent increase in the length or circumference of the exercise belt 20. The exercise belts 20 can be of various sizes depending on the size of the person using the belt. In general, the exercise belt is sized to the average waist size of the average American male or female. The exercise belt should be long enough to allow for a snug fit around the circumference of the waist.

The average waist size for women is 37 inches and enough material (length) should be provided for women of almost all girths to allow for use of the exercise belt 20. Likewise, the average waist size for a man is 40 inches and enough material (length) should be provided for men of almost all girths to allow for use of the exercise belt. By way of example, the exercise belt can range from 37 inches to 45 inches in length (circumference) and from three inches to six inches in width, preferably five inches.

Figure 8:
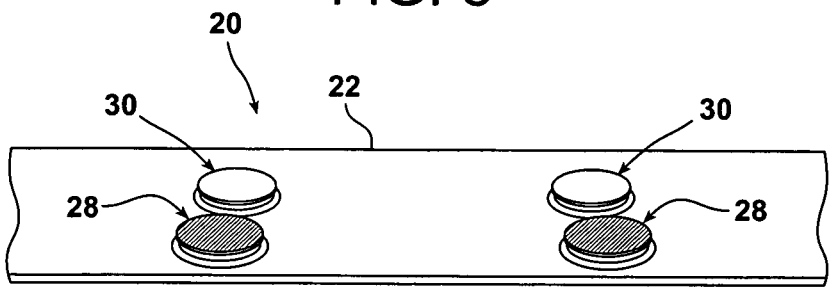
FIG. 8 is a partial perspective view of the exercise belt of this invention wherein the four equilibrium indicators or buttons indicate that the exercise belt is in the proper position and the exercise is being done correctly.
Figure 9:
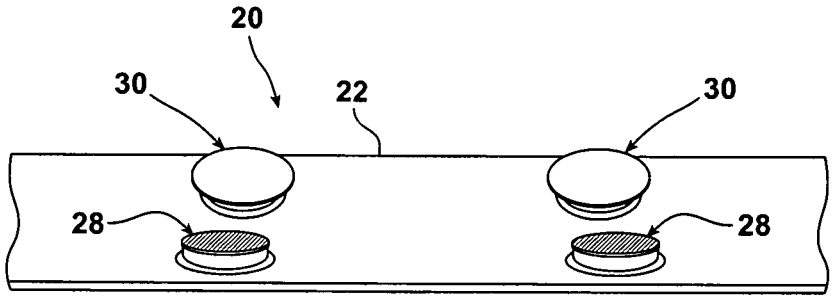
FIG. 9 is a partial perspective view of the exercise belt of this invention wherein the four equilibrium indicators or buttons indicate that the exercise belt is not in the proper position and/or the exercise is being done incorrectly.
Figure 10:
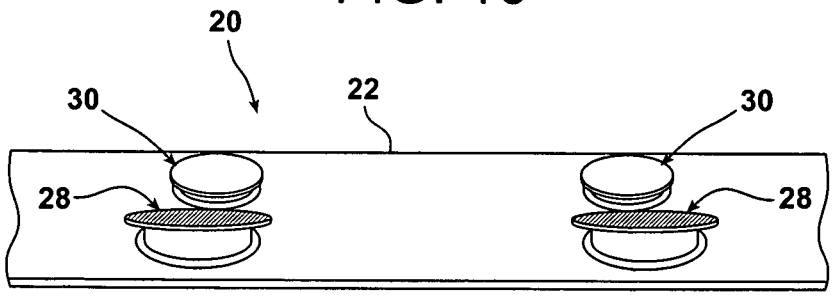
FIG. 10 is a partial perspective view of the exercise belt of this invention wherein the four equilibrium indicators or buttons indicate that the exercise belt is not in the proper position and/or the exercise is being done incorrectly.

Referring to FIGS. 8, 9 and 10, preferably, the exercise belt has two abdominal cavity indicators 28 and two pelvic cavity indicators 30. These indicators 28,30 are flat "buttons" that pass through the belt 20, rest against the body on the inside of the belt 20 and are freely movable, yet mounted to the belt 20. The equilibrium indicators 28, 30 are mounted with riveting, ironing on, or the bending the corners of the metal into the elastic portion 26 of the exercise belt 20. The indicators 28, 30 are located approximately three inches lateral to the umbilicus on either side, i.e., an approximate six inch span between equilibrium indicators 28, 30. These indicators 28, 30 enable the person exercising to gauge whether the actions performed during the exercise are correct or incorrect. When all the indicators 28, 30 are in vertical alignment and substantially in the same plane, as seen in FIG. 8, throughout each complete action (cycle) performed, the exercise is being performed correctly. If they are not in alignment, as shown in FIGS. 9 and 10, the user needs to adjust their performance by, for example, slowing down or modifying the way each action is performed in order to do the exercise properly. Once alignment is achieved the user needs to continue to perform each complete action (cycle) in the same manner and consistently monitor the equilibrium indicators 28, 30 to make sure that they do not reverting back to incorrect usage (FIGS. 9 & 10).

For example, FIG. 9 shows the end-user incorrectly performing the action because the four equilibrium indicators 28, 30 are not vertically in alignment or in the same plane with each other.

In this case, the user is mistakenly placing too much emphasis on utilizing the pelvic cavity to perform the complete action and as a result the pelvic equilibrium indicators 28 are laterally forward from the abdominal equilibrium indicators 30. In this scenario the user will not experience the full benefits of the exercise. To correct this the user will need to better coordinate the action of the abdominopelvic region in order to achieve correct alignment of the two abdominal indicators 30 together with the two pelvic indicators 28.

In FIG. 10, the user is incorrectly performing the action because the four equilibrium indicators 28, 30 are not vertically in alignment. In this case the user is mistakenly placing too much emphasis on utilizing the abdominopelvic cavity to perform the complete action and as a result the abdominal equilibrium indicators 28,30 are laterally forward from the pelvic equilibrium indicators. In this scenario the user will not experience the benefits of the exercise as rapidly. To correct this the user will need to better coordinate the action of the abdominopelvic region in order to achieve correct vertical alignment of the two abdominal indicators 28 together with the two pelvic indicators 30.

Although it might be impossible to accurately perform each complete action with the four balance indicators 28, 30 in perfect alignment due to the convex nature of the abdomen depending on the end-users girth and gender, the user should strive as much as possible to perform each action so that the indicators are in alignment, particularly when first starting to do the exercise routine.

Among the physical benefits that are gained through proper use of the indicators 28, 30 and placement on the body is that the user will be able to more easily perform a full action using the device. The indicators 28, 30 provide the user with external reference points to visually measure his/her performance. The four balance indicators 28, 30 provide the user with enhanced psychological benefit in that he/she is working towards achieving the goal of perfectly performed cycles of the exercise routine which will also reward the user with more rapid results.

The mind-body coordination benefits that are gained through proper placement of exercise belt 20 over the pelvic cavity provides the user increased focus on the pelvic cavity by shifting their awareness towards this exact area of their body. Because the pelvic cavity is located deep inside where the human body's critical lower organs reside (including the urinary bladder), normal mind-body awareness of this region is not as intimate or strong as with nearly any other part of the body likes ones upper extremities (shoulders, arms, and hands) or ones lower extremities (hips, legs, or feet) which get used on a relatively frequent basis. Therefore the exercise belt 20 and the exercise succeed by giving the user a specific area on which to concentrate their efforts and attention (abdominopelvic cavities) utilizing their vision and tactile sensations.

To determine if a patient requires the use of the exercise of this invention, a physical examination of the abdominopelvic region is performed. Palpation often reveals objective physical differences in the abdominopelvic region, indicating that the exercise of this invention will be helpful. Objective signs upon palpation of the abdominopelvic region include increased resistance upon direct downward pressure of the abdominopelvic region signaling hardness and pressure of the intestines. Subjective signs upon palpation of the abdominopelvic region experienced by the patient include fear of gentle pressure, pain, discomfort, and least frequently the urgent need to urinate.

After the exercise of this invention has been followed by the patient for an initial seven day time period, physical re-examination of the abdominopelvic region shows immediate objective changes nearly 100% of the time as long as the patient is properly following directions for successful use of the exercise. Objective signs upon palpation of the abdominopelvic region after this initial period, include decreased resistance signaling minimized hardness and pressure of the intestines. Subjective signs upon palpation of the abdominopelvic region during re-examination following initiation of the exercise include minimal fear of gentle pressure, minimal pain, minimal discomfort, and minimal urgent need to urinate.

Every patient who under goes physical examination for initiation of the exercise frequently will display different affected areas within the abdominopelvic region. The majority of patients will overall experience affected areas located inferior to the umbilicus and superior to the pubic bone. http://en.wikipedia.org/wiki/File:Gray829.png. The minority of the patients affected areas will include the area superior to the umbilicus and inferior the anterior mediastinum. http://upload.wikimedia.org/wikipedia/commons/a/ab/Mediastinum.png While various changes may be made in the detailed construction and processes of this invention, it will be understood that such changes will be within the spirit and scope of the present invention. Having thus described the invention in detail, it is to be understood that the foregoing description is not intended to limit the spirit and scope thereof. What is desired to be protected by Letters Patent is set forth in the appended claims.

What is claimed is:

1. An holistic exercise method for enhancing urine retention of a bladder in a person, the bladder having reduced urine retention, the method comprising the steps of:

a) providing a continuous elastic resistance exercise belt that includes an elastic material in a front portion of the belt and is of a size sufficient to encircle the abdominopelvic region of the person performing the method, the exercise belt having sides, and a top edge and a bottom edge, the belt further includes at least two abdominal indicators mounted to the front of the belt proximate the top edge and at least two pelvic indicators mounted to the front of the belt proximate the bottom edge, each abdominal indicator mounted above a pelvic indicator, each indicator protruding from the belt and visible by the person performing the method, the abdominal indicators and the pelvic indicators resting against the person's abdomen and pelvic areas, respectively, throughout the method and when aligned with each other provide a visible indicia that the method is being performed correctly to obtain optimum enhanced urine retention by the bladder;

b) removably mounting the exercise belt around the abdominopelvic region of the person performing the method, wherein a portion of the bottom edge is placed close to and superior to the pubic symphisis and the bottom edge of the sides of the belt are positioned over the iliac crest of the ileum ("hip bones");

c) expanding the abdominopelvic region outward as far as possible by the person performing the method, against the resistive force of the exercise belt; and then d) pulling the abdominopelvic region back into the body as far as possible with the resistance exercise belt elastically retained in a snug position against the exterior of the abdominopelvic region;

e) repeating a cycle comprising the expanding step c) and the pulling step d) for a sufficient number of cycles per day for a sufficient number of days to enhance the urine retention of the person's bladder.

f) continuously monitoring the indicators during steps c), d) and e) to determine if the method is being performed correctly, whereby the bladder expands to enhance the person's urine retention.

2. The exercise method of claim 1, wherein the cycle is repeated at least 50 cycles per day.

3. The exercise method of claim 1, wherein the cycle is repeated up to 750 cycles per day.

4. The exercise method of claim 1, wherein the cycle is repeated from about 50 cycles per day to about 750 cycles per day.

5. The exercise method of claim 1, wherein the cycle is repeated from about 50 cycles per day to about 100 cycles per day.

* * * * *